United States Patent [19]

Meyer

[11] Patent Number: 4,522,001

[45] Date of Patent: Jun. 11, 1985

[54] SET OF BRICKS WITH PLUGGING CONNECTIONS

[76] Inventor: Anton Meyer, Gratzerstrasse 3, D-8070 Ingolstadt 2, Fed. Rep. of Germany

[21] Appl. No.: 364,228

[22] Filed: Apr. 1, 1982

[51] Int. Cl.[3] ..... A63H 33/08

[52] U.S. Cl. ..... 52/309.1; 46/23; 46/26; 52/585; 446/128

[58] Field of Search ..... 52/309.1, 585, 589; 46/23, 24, 25, 26; 273/58

[56] References Cited

U.S. PATENT DOCUMENTS

| | | | |
|---|---|---|---|
| 2,826,906 | 3/1958 | Rice | 52/585 |
| 3,234,683 | 2/1966 | Christiansen | 46/23 X |
| 3,236,004 | 2/1966 | Christiansen | 46/23 |
| 3,488,881 | 1/1970 | Holzer | 46/23 |
| 3,862,512 | 1/1975 | Vogel | 46/26 X |

FOREIGN PATENT DOCUMENTS

| | | | |
|---|---|---|---|
| 2201629 | 3/1973 | Fed. Rep. of Germany | 52/589 |
| 1232715 | 10/1960 | France . | |
| 2144996 | 2/1973 | France . | |
| 1269755 | 4/1972 | United Kingdom . | |

*Primary Examiner*—J. Karl Bell

*Attorney, Agent, or Firm*—Horst M. Kasper

[57] ABSTRACT

A set of bricks has plugging connections which, on the top side, have male elements and at their lower sides have female pockets to take up the male elements on another such brick. Two bricks may be put together by pushing the male elements of the one brick into the female pockets of the other brick. The material of the bricks is soft synthetic resin, such as high-pressure polyethylene (PE-soft) which has good gripping properties, keeps its form, is not damaged by abrasion and keeps to the conditions of laws in connection with the use of synthetic resins with foodstuffs. The female pockets which are placed coaxially with respect to the male elements are formed by sleeve-like wall parts which, at the outer sides of the brick, have rounded off brick corners and in the inner part of the bricks are responsible for forming bracing walls.

12 Claims, 5 Drawing Figures

SET OF BRICKS WITH PLUGGING CONNECTIONS

BACKGROUND OF THE INVENTION

The present invention is with respect to a set of synthetic resin bricks with plugging connections, with rounded brick corners and with at least one cylindrical male element on one face and an equal number of female pockets for such male elements on an opposite side, the inner part of many-element bricks being reinforced by bracing walls.

In the prior art bricks with plugging connections have mostly been made of a generally hard and smooth synthetic resin material so that the bricks are not joined strongly enough together and furthermore, all the time the bricks are being played with, there will be an incressant clip-clop sort of noise. Furthermore, some pain is likely to be experienced by anyone going barefoot over a floor with such bricks all over it, as is normally the case, because of the bricks' sharp corners (however, for an example of rounded-off bricks, see Japanese Pat. Nos. 25 92 61 and 54 15 39).

Furthermore, bricks with plugging connections have been designed made of soft synthetic resin, but, however, they are of a completely different design or are poor in keeping their form and with respect to strength.

GENERAL OUTLINE OF THE INVENTION

One purpose of the present invention is that of designing a set of bricks with plugging connections made up of synthetic resin and which, using only a small number of basic forms, make it possible for a great number of different building structures to be produced and furthermore are pleasing when handled and keep their form, while making a strong join on being plugged together.

For effecting this purpose and further purposes in the present invention a set of synthetic resin bricks with plugging connections, with rounded brick corners and with at least one cylindrical male element on one face and an equal number of female pockets for such male elements on an opposite side, the inner part of many-element bricks being reinforced by bracing walls. Further developments of the invention are made clear in the claims.

The set of bricks with plugging connections of the present invention makes it possible for bricks, after being plugged together, to be turned in relation to each other so that a great number of different possible building structures may be produced. Walls may be placed running together at any desired angle and round structures such as wheels, gearwheels, towers etc. become possible. Before a building structure is completed, separate bricks, or complete groups thereof, may be turned in relation to each other, giving the idea that the material may be formed in the hand like clay, more specially if a soft synthetic resin is used; as for example high-pressure polyethylene (PE-soft) of the type PE-M-20-200-00 (see German Industrial Standard (DIN) 16 776). This brick material may readily be gripped and has a pleasing feel in the hand. It is not damaged by rubbing (abrasion), keeps its form and keeps fully to the conditions of foodstuff laws. A strong join is produced between the bricks when plugged together and, on the one hand, because of the rounding off of the brick corners and, on the other hand, because of the use of a soft synthetic resin, it is not possible for even the youngest child to be injured by the bricks.

To make certain that the male element of one brick is not only kept joined up within the female pocket of an other brick, but furthermore is well guided when the bricks are turned in relation to each other, the male element has a generally effective or acting height. Good properties are produced with an acting height of about one-fourth to one-half and, more specially, one-third of the height of the female pockets of the brick. The female pocket for the male element is a sleeve-like wall part on which the male element is plugged and seated coaxially, the sleeve-like wall part having a cylindrical outer face forming the rounded off corners of the brick. Inasfar as the sleeve-like wall part, in the case of a many-part brick, takes up a position within the brick, it has the function of a bracing wall so that the brick keeps its form to the desired degree.

For gripping the male elements in the female pockets, certain size limits or tolerances have to be kept to on injection molding the bricks. A sliding fit in line with the "ISA-fits" has turned out to give the desired effects.

To make the walls of the bricks of even thickness, that is to say on the one hand where one female pocket is joined up with the next one in the case of bricks with more than one such pocket and, on the other hand, were the straight side walls of a brick are joined up with the sleeve-like female pockets, as part of a further development of the invention of good effect, the cylindrical wall parts of the sleeve-like female pockets (in the inner part of the bricks) are made thinner than the wall at the sides of the bricks. On the same lines, the sleeve-like female pockets with the top wall (joining up the male element) and the male elements themselves are best made with a lesser wall thickness. Because of the decrease in the wall thickness between the cylindrical inner wall parts of one sleeve-like female pocket and the next one, there is an inbetween space, even where the pockets are nearest together, such space being best generally equal to the wall thickness of the sleeve-like female pockets at the corners of the bricks. Because the walls of the bricks are of even thickness, there is generally no danger of "pitting" or "caving in" on injection molding so that the female pockets and the male elements next to them are kept truly parallel. The bricks may readily be plugged together but nevertheless make a strong join. Because of the space between one female pocket and the next one, the injection mold may be made stronger so that it has a longer working life.

As part of a preferred further development of the invention, the male elements have coned edges, this making it simpler for the male elements to be slipped into the sleeve-like female pockets. A round, concentric opening at the ends of the male elements is used to make certain that no air is shut in between the male element and the sleeve-like female pocket which would make it harder for the two parts to be plugged together. Such an opening may as well be used for putting in a rod, which may be placed right the way through the brick structure, for making the structure stiffer, or it may be used as a turnpin. There is a still further effect of the opening inasfar as the brick takes the form of a small pipe. Further effects are produced, in this respect, when the bricks are placed in water. The bricks may be made bouyant.

As noted earlier, it is possible, on using a small number of simple, basic forms of bricks with plugging connections, to make building structures based on a great range of different ideas. An account will now be given of a set of bricks with plugging connections made up of such basic forms of bricks. A great number of other special forms of such bricks are possible, of which one has been taken for the present purpose simply by way of example.

LIST OF FIGURES AND DETAILED ACCOUNT OF WORKING EXAMPLES OF THE INVENTION

Figure 1:
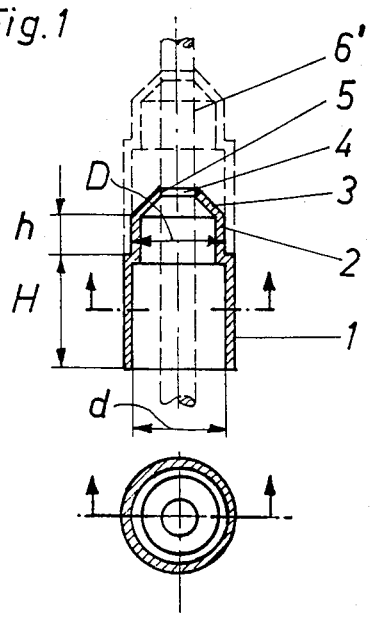
FIGS. 1 to 3 are views in lengthways and cross-section of bricks with plugging connections having two or three male elements and the same number of female for the male elements.

As will be seen from FIG. 1, a brick with plugging connections has a cylindrical or sleeve-like female pocket 1 with a male element 2 placed coaxially thereon. The inner diameter d of the female pocket 1 has the same rated size as the outer diameter D of the male element 2 and on producing such bricks the tolerances to be kept to are to be such that on the one hand the male element 2 of one brick may be pushed into the sleeve-like female pocket 1 of an other brick without any great force while, on the other hand, seeing that a gripping join is produced between the two bricks.

A gripping seating effect of the male element 2 in the sleeve-like female pocket 1 is made more readily possible (on using a soft synthetic resin) if the male element has a generally great acting or effective height and in the present case in hand, the acting height h is equal to about one-third of the height H of the female pocket so that a large contact or gripping face between the female pocket 1 and the male element 2 between plugged-together bricks is made certain of.

As may be seen from the figure, the end face 3 of the male element 2 is coned off at an angle of about 45° and concentrically in the middle of the end face 3 there is a round or cylindrical opening 4, whose limiting wall 5 is generally parallel to the axis of the brick. Because of this opening 4, the brick may have a rod 6' placed within it so that structures of large size may be made stiffer, or such rod may be used as a turnpin for structures having turning parts. The diameters of the opening 4 and the rod 6' are such that the rod is gripped in position, the gripping effect being greater or lesser in a way dependent on which end the rod 6' is pushed in from into opening 4, this being because of the coned form of the end face 3.

The single element brick noted is best made with such a size that, although a child at play is able to put it into its mouth, it will not go down into the child's throat. The size is furthermore such that, on the one hand, interesting structures may be produced with only a small number of parts and there is little chance of loss of the bricks even when used out-of-doors. The height H of the female pocket, which is best made equal to the outer diameter of the female pocket so that bricks with male elements placed at right angles to each other may be produced, is best between 18 and 20 mm. A brick wall thickness of about 1.5 mm has turned out to give good effects. In this case, the inner diameter d of the female pocket 1 and the outer diameter D of the male element 2 will be about 15 to 17 mm. The acting height h of the male element 2 is best 6 to 7 mm. The inner diameter of the opening 4 and the outer diameter of rod 6' will be about 6 mm.

Figure 2:
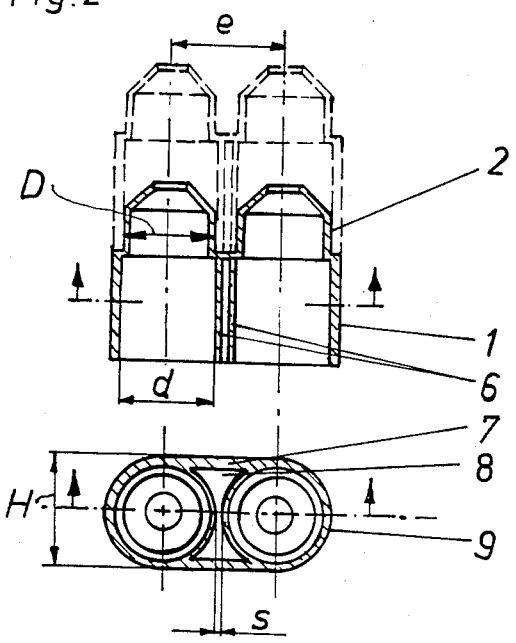
Figure 3:
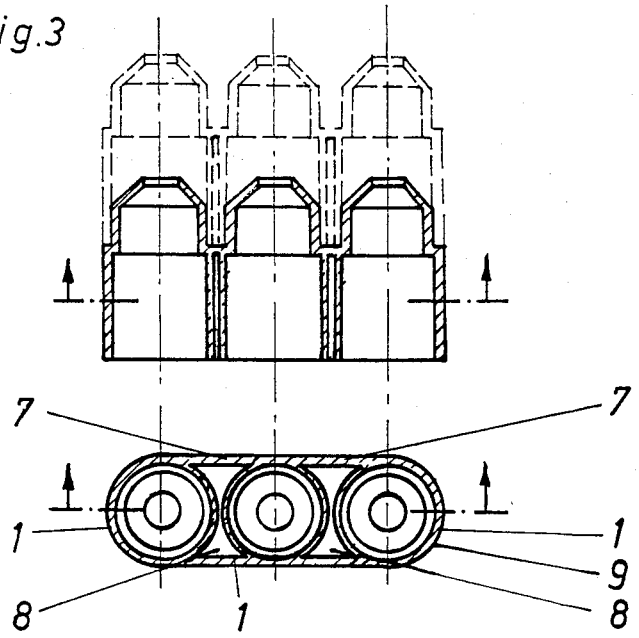

As will be seen in FIGS. 2 and 3, "bricks" or brick-groups having more than one element are simply formed by placing single-element bricks as in FIG. 1 next to each other. To make the structures stiffer and more pleasing to the eye, however, the female pocket 1 of one brick element and the next one are joined up by further side wall bridge-pieces 7 and covering wall parts 8 so that the many-element bricks have flat side walls while at the corners the sleeve-like female pockets 1 take the form of rounded-off structures 9. The female pocket walls within the brick make such a many-element brick stiffer.

As will be seen from the figure, bracing walls 6 inside the brick are thinner than the walls of the female pockets at the rounded parts 9 and than the side walls 7. Because of this decreased thickness of bracing walls 6, there is an inbetween space s between the two, where they are nearest together. This inbetween space s is, as will be seen from the figure, about equal to the wall thickness of the female pocket 1 at the rounded parts 9 and the side walls 7. Because of this (and in view of the fact that the center distance e of the brick elements is equal to the outer diameter H' of the female pocket), the thickness of the bracing walls 6 is about half the size of the thickness of the walls of the rounded off parts 9 and of the side walls 7.

In order to make do with as little material as possible, and because they are strong enough, male elements 2 and covering wall 8 of the brick are, as well, produced with a wall thickness less than that of the rounded parts 9 and the side walls and the wall thickness is best made equal to that of the bracing walls 6.

Many-element bricks with three or more elements may be designed on the same lines.

As we have seen, the center spacing e between the male elements is equal to the outer diameter H' of the sleeve-like female pocket 1. On plugging together a number of bricks, it will be seen, for this reason, that the bricks will have their outer faces against each other, this being responsible for a further gripping effect between the separate bricks. Because of tolerances, which, in any case, will be present, in the spacing between the male elements, the gripping effect between the bricks will be increased by increasing the number of elements thereof. To make certain that no overly great force is needed on plugging such many-element bricks together and unjoining them, the male element center spacing is to keep to tight tolerances.

The single-element, two-element and three-element bricks to be seen in FIGS. 1, 2 and 3 are generally all that will be needed for building a great number of different structures. It will, however, be clear that a great number of further forms of bricks are possible and, for example, bricks with four or six elements in two lines or even plate-like bricks may be produced. Furthermore, the bricks may be made in an angled or L-form. As we have seen, a single brick may have male elements on female pocket faces which are normal to each other so that building in directions normal to each other may take place. Furthermore inside-out bricks would be possible in which male elements will be present on opposite sides of a brick or one side of a brick would have one male element together with a female pocket.

Figure 4:
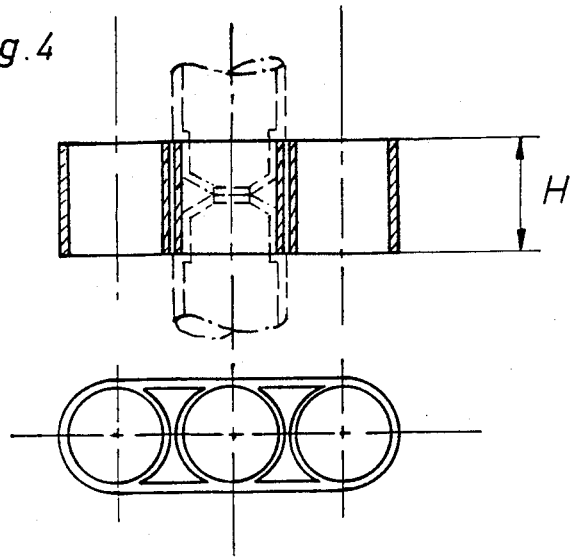
FIG. 4 is a lengthways and cross-section of a brick in the form of a female pocket which is open at its two ends.

A specially simple form of "inside-out" or inverse brick is a brick in the form of a female sleeve which is open at its two ends having the size of a normal brick, in which respect, as is the case with normal bricks, many-element sleeve bricks will be possible. Such a many-element sleeve brick is to be seen in FIG. 4. By plugging normal bricks on the two sides into a sleeve brick, the direction of building is changed round. To make certain that plugging in from the two sides is possible without anything in the way, the overall height of the male elements of a brick is equal to or less than half the height H of the female pocket.

Furthermore end bricks are possible for smoothly ending a structure, such end bricks having a flat covering wall in place of male elements. Further end bricks may be bricks with sharp corners and rounded off corners.

Figure 5:
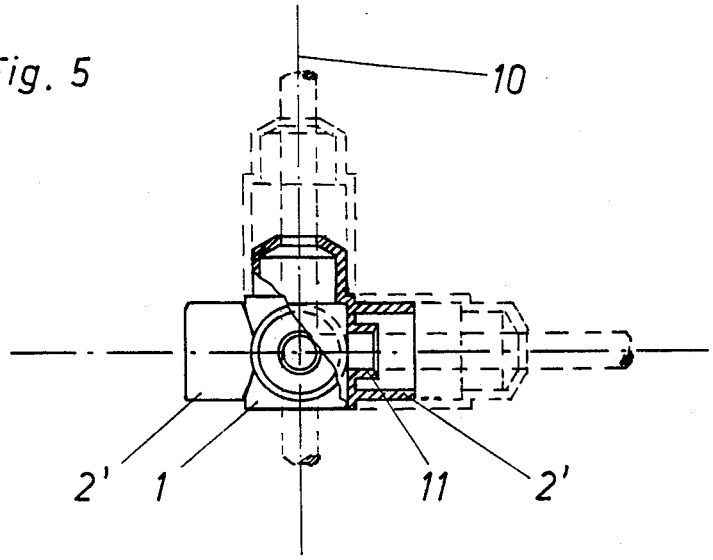
FIG. 5 is a side and plan view, in part section, of a brick with plugging male elements in faces thereof which are at a right angle to each other.
Figure 5:
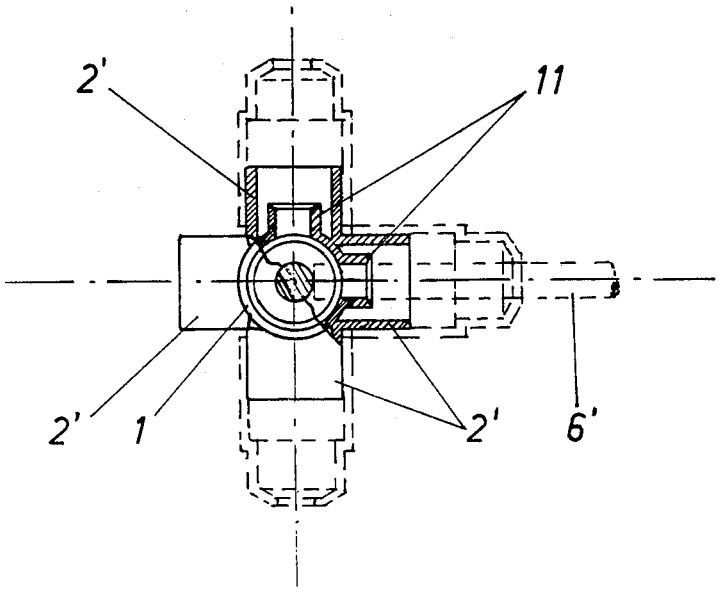

A brick with male elements on faces which are at a right angle to each other will be seen in FIG. 5. The sleeve or pocket-like gripping connection of a single-element brick as in FIG. 1 has one, two, three or (as figured) four male elements 2' molded thereon, without however (for production engineering reasons) end walls. To make it possible for bricks (marked in broken lines) plugged on the male elements 2' to be rested fully on pocket 1, the same may have a ring-like collar (not marked) with a stop face. The pocket 1 has concentric male elements 2' in it for plugging rods 6' in and plugging them right through.

I claim:

1. In a set of synthetic resin bricks with plugging connections, with side walls having rounded brick corners and with at least one cylindrical male element on one covering wall part and an equal number of female pockets for such male elements on an opposite side, the inner part of the many element bricks being reinforced by bracng walls, wherein the brick material is a soft synthetic resin having good gripping properties, keeping its form, resistant to abrasion and keeping to the condition of laws on the use of synthetic resin in connection with foodstuffs and wherein the female pockets are formed by sleeve-like wall parts which at the outer sides of the bricks take the form of the rounded off brick corners and in the inner part of the many-element bricks, limited by the straight side walls, take the form of the bracing walls and wherein the walls are relatively thin as compared to the dimensions of the synthetic resin bricks.

2. A set of bricks as claimed in claim 1, wherein the brick material is high-pressure polyethylene.

3. A set of bricks as claimed in claim 1, wherein the sleeve-like wall parts of the female pockets in the inner part of the bricks are made with a thickness which is less than the wall thickness at the outer sides of the brick and, for this reason, there is an inbetween space between the inner wall parts of one female pocket and the next one even where they come nearest together.

4. A set of bricks as claimed in claim 3, wherein covering walls are formed running normal to the pockets, and the male elements and the covering walls are designed with a wall thickness which is less than the wall thickness at the rounded off brick corners.

5. A set of bricks as claimed in anyone of claims 1, 2, 3 or 4, wherein the male elements have coned ends, such ends having concentric round openings.

6. A set of bricks as claimed in claim 5, having rods to be grippingly placed in the openings.

7. A set of bricks as claimed in claim 1, wherein the male elements have an overall height equal to the height of the sleeve-like female pockets and in that the outer diameter of the female pockets is equal to their height.

8. A set of bricks as claimed in claim 1, wherein the male elements have an overall height somewhat less than half the height of the sleeve-like female pockets and in that the outer diameter of the female pockets is equal to their height.

9. A set of bricks as claimed in claim 1, having a plugging connection brick in the form of lined-up female pockets open at their two ends.

10. A set of bricks as claimed in claim 1, having a plugging connection brick in the form of a female pocket open at its two ends.

11. A set of bricks as claimed in claim 1, having a plugging connection brick with male elements and/or female pockets on opposite sides of the bricks.

12. A set of bricks as claimed in claim 1, wherein the center distance e of the brick elements is equal to the outer diameter H' of the female pocket and wherein the thickness of the bracing walls is about half the size of the thickness of the walls of the side walls.

* * * * *